United States Patent [19]

Lang et al.

[11] 4,315,457

[45] Feb. 16, 1982

[54] DUCT ATTACHMENT MEANS FOR AN AIR CONDITIONING UNIT

[75] Inventors: Richard D. Lang, Chittenango; Theodore S. Bolton, Liverpool, both of N.Y.

[73] Assignee: Carrier Corporation, Syracuse, N.Y.

[21] Appl. No.: 151,040

[22] Filed: May 19, 1980

[51] Int. Cl.[3] ..... F24F 13/02

[52] U.S. Cl. ..... 98/40 C; 98/40 R; 98/41 R; 98/114

[58] Field of Search ..... 98/39, 40 R, 40 C, 40 V, 98/40 VM, 40 N, 41 R, 102, 103, 108, 106, 114; 62/262; 285/424

[56] References Cited

U.S. PATENT DOCUMENTS

| | | | |
|---|---|---|---|
| 2,656,156 | 10/1953 | Wilcox | 98/40 C |
| 2,727,455 | 12/1955 | Miller et al. | 98/40 C X |
| 3,018,711 | 1/1962 | Welch et al. | 98/40 N X |
| 3,111,075 | 11/1963 | Hoyle et al. | 98/40 V |
| 3,264,971 | 8/1966 | Dangauthier | 98/40 N X |
| 3,717,082 | 2/1973 | Jung | 98/114 |

FOREIGN PATENT DOCUMENTS

| | | | |
|---|---|---|---|
| 2545884 | 4/1977 | Fed. Rep. of Germany | 98/40 C |
| 2625091 | 12/1977 | Fed. Rep. of Germany | 98/103 |
| 497471 | 9/1954 | Italy | 98/40 C |

*Primary Examiner*—William E. Wayner
*Assistant Examiner*—Harold Joyce
*Attorney, Agent, or Firm*—J. Raymond Curtin; Robert P. Hayter

[57] ABSTRACT

A duct adapter for use in conjunction with an air conditioning unit is disclosed. This adapter attaches to a discharge opening of an air conditioning unit and acts to divide the stream of conditioned air into multiple streams, one being discharged into the enclosure containing the air conditioning unit and a separate stream being discharged into a duct for delivery at a distant location. Means for attaching the adapter to the air conditioning unit and a damper assembly therein are additionally disclosed.

10 Claims, 5 Drawing Figures

DUCT ATTACHMENT MEANS FOR AN AIR CONDITIONING UNIT

BACKGROUND OF THE INVENTION

1. Field of the Invention

This invention relates in general to duct attachment means for use with an air conditioning unit. More specifically, this invention concerns an adapter for attachment to an air conditioning unit such that air being discharged from the unit may be divided into separate air streams for discharge at separate locations.

2. Prior Art

Air conditioning units which are commonly used for light commercial applications such as hotels, dormitories and office buildings often are of the type known as a packaged terminal air conditioner. These packaged terminal air conditioners extend through the wall of the enclosure and normally have a condensing section located in communication with ambient air for discharging heat energy. An evaporator section of the unit is provided in communication with the enclosure air for conditioning said air as it is drawn through the unit.

These units are usually spaced along an exterior wall of the enclosure to be conditioned located within a specific sub-enclosure therein. Often it is desirable to treat the air in more than one sub-enclosure utilizing a single packaged terminal air conditioning unit. To accomplish this, an adapter has been developed which may be inserted into the normal air discharge flow path of the packaged terminal air conditioning unit. This adapter has multiple discharge openings therein and a damper assembly for directing air between these discharge openings. One of these discharge openings is used to discharge air into the sub-enclosure where the air conditioning unit is located. Another of these discharge openings is connected to a duct for conducting the conditioned air to a separate sub-enclosure.

The adapter assembly and apparatus described herein is suitable for uses other than with a packaged terminal air conditioning unit. This adapter assembly may be incorporated into fan coil units or other air conditioning flow regulating applications.

SUMMARY OF THE INVENTION

An object of the invention is to provide a housing for converting a single air stream into multiple air streams.

A further object of the present invention is to provide an adapter assembly capable of diverting air discharged into a subenclosure such that a portion of the air is discharged into the enclosure and a portion is discharged into a duct connected to a separate subenclosure.

A further object of the present invention is to provide an adapter for assembly to a packaged terminal air conditioning unit.

Another object of the present invention is to provide a safe, economical, easy to manufacture and easy to assemble adapter for use in conjunction with a packaged terminal air conditioning unit for diverting a portion of the conditioned air into a separate discharge air stream.

Other objects will be apparent from the description to follow and the appended claims.

These objects are achieved according to a preferred embodiment of the invention by the provision of a housing which may be connected to a packaged terminal air conditioning unit. The air conditioning unit has a discharge opening covered by a removable grille. The adapter is designed to be connected to the air conditioning unit at the discharge opening. The adapter has a plurality of walls, some of which are adapted to coact with structural portions of the air conditioning unit to secure the adapter thereto. The adapter additionally has a top wall defining grille support surfaces wherein the grille for the air conditioning unit may be inserted to regulate the discharge of air therefrom. The adapter has at least one side wall having a duct opening therein such that a duct may be connected thereto to receive a portion of the air flowing into the adapter. A damper is provided within the adapter for directing air between the discharge opening and the duct opening.

DESCRIPTION OF THE PREFERRED EMBODIMENT

The apparatus as set forth herein will be described in reference to a packaged terminal air conditioning unit. It is to be understood that the adapter for diverting an air stream has like applicability to other types of air conditioning units including fan coil units. It is to be further understood that although this adapter is described with a particular damper embodiment other damper assemblies serving a like purpose would also be suitable.

Figure 1:
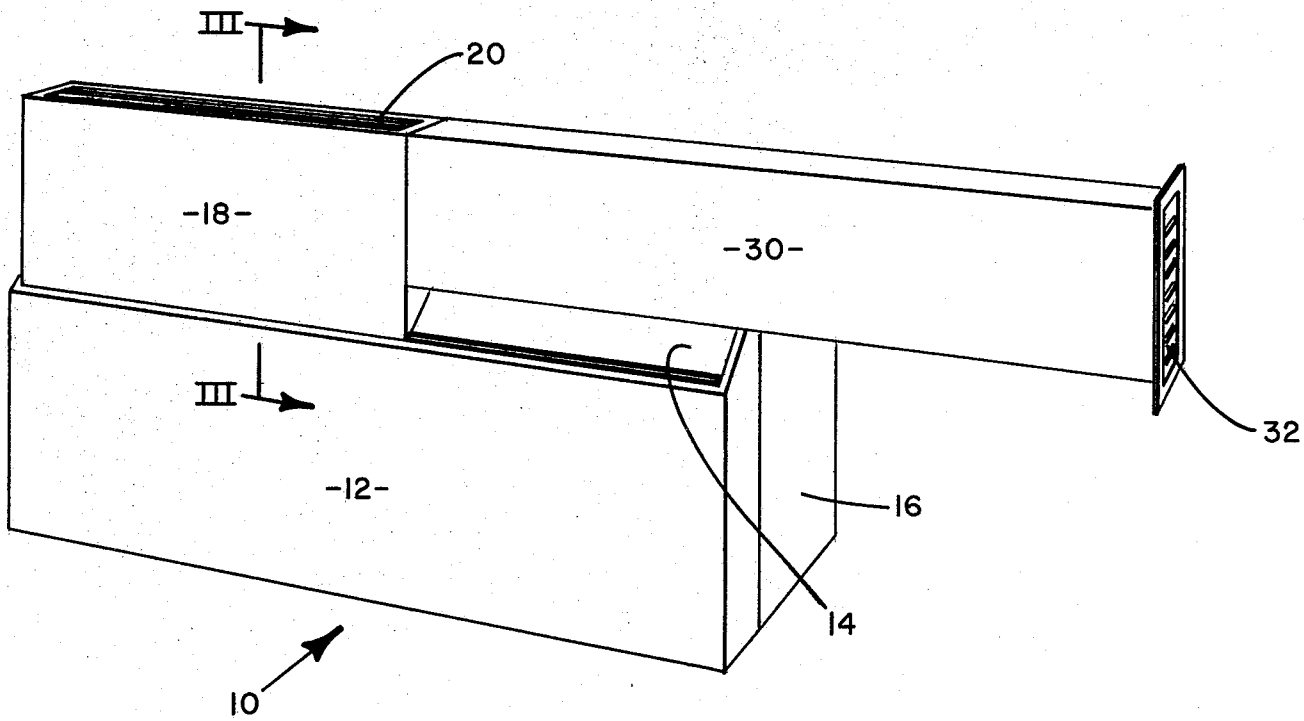
FIG. 1 is an isometric view of a packaged terminal air conditioning unit including an adapter and duct extension.

Referring first to FIG. 1 there may be seen a packaged terminal air conditioning unit 10 having a front cover 12, side 16 and control door 14 covering the control portion thereof. Adapter 18 is shown secured to a portion of the unit 10, this adapter being secured at the position wherein the conditioned air is discharged from the unit. Discharge grille 20 is shown attached to the top of adapter 18 for directing conditioned air into the enclosure where the unit is located. Duct extension 30 is shown connected to a side wall of adapter 18 and has attached thereto register 32. Duct extension 30 would normally extend through a wall into an adjacent enclosure such that a portion of the conditioned air being discharged from the unit 10 is conducted to the adjacent enclosure through the duct extension.

Figure 2:
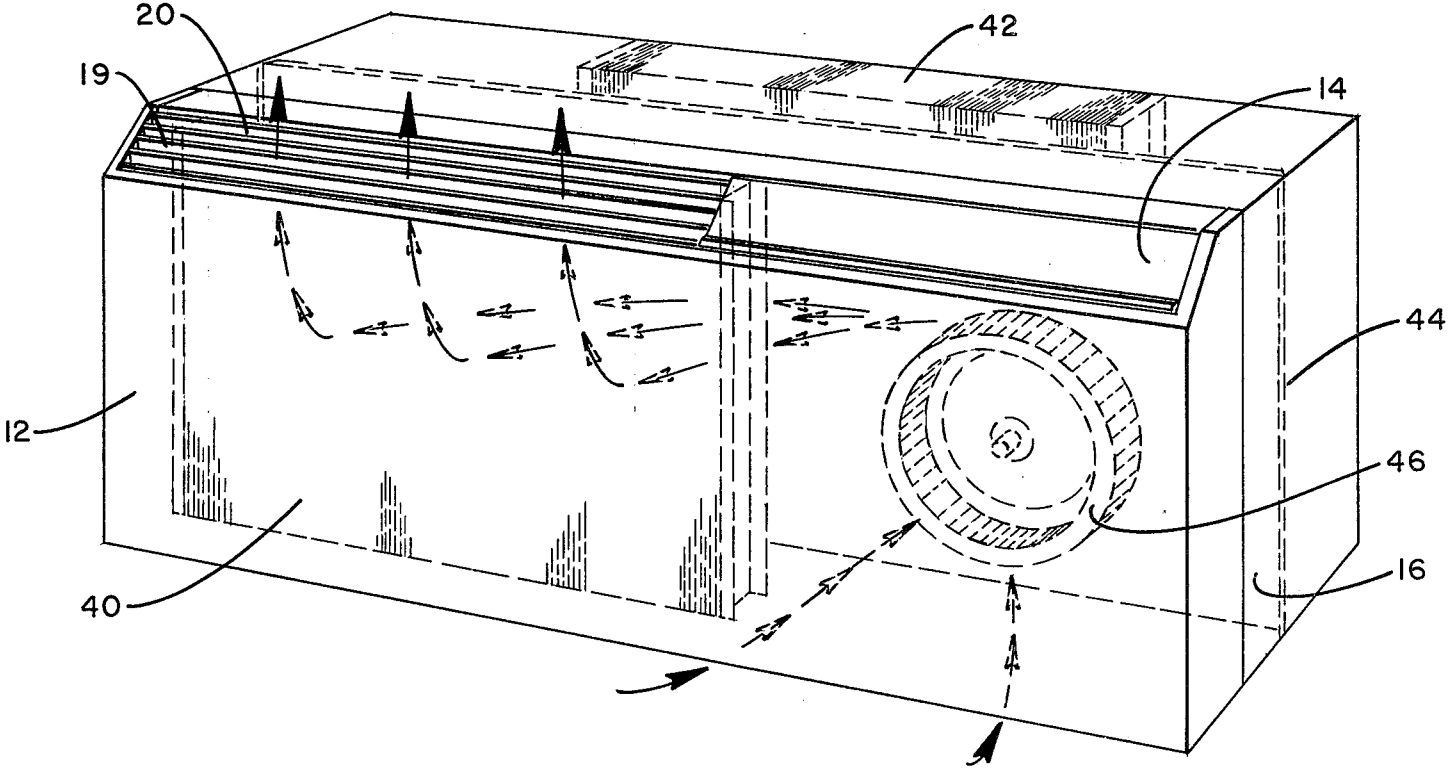
FIG. 2 is a schematic representation of the packaged terminal air conditioning unit of FIG. 1 showing the air flow in the evaporator section of the unit.

Referring now to FIG. 2 there may be seen the indoor air flow path of a packaged terminal air conditioning unit. Evaporator fan 46 draws air upwardly from the bottom of the unit and discharges that air behind evaporator 40. The air then flows through evaporator 40 and is discharged upwardly through discharge opening 19. Discharge grille 20 is shown located to cover discharge opening 19 such that in an application without the adapter, means are provided for directing the air being discharged from the unit and a cover is provided to prevent foreign objects from being inserted into the unit. Partition 44 divides the unit into an indoor evaporator section and an outdoor section containing condenser 42.

Figure 3:
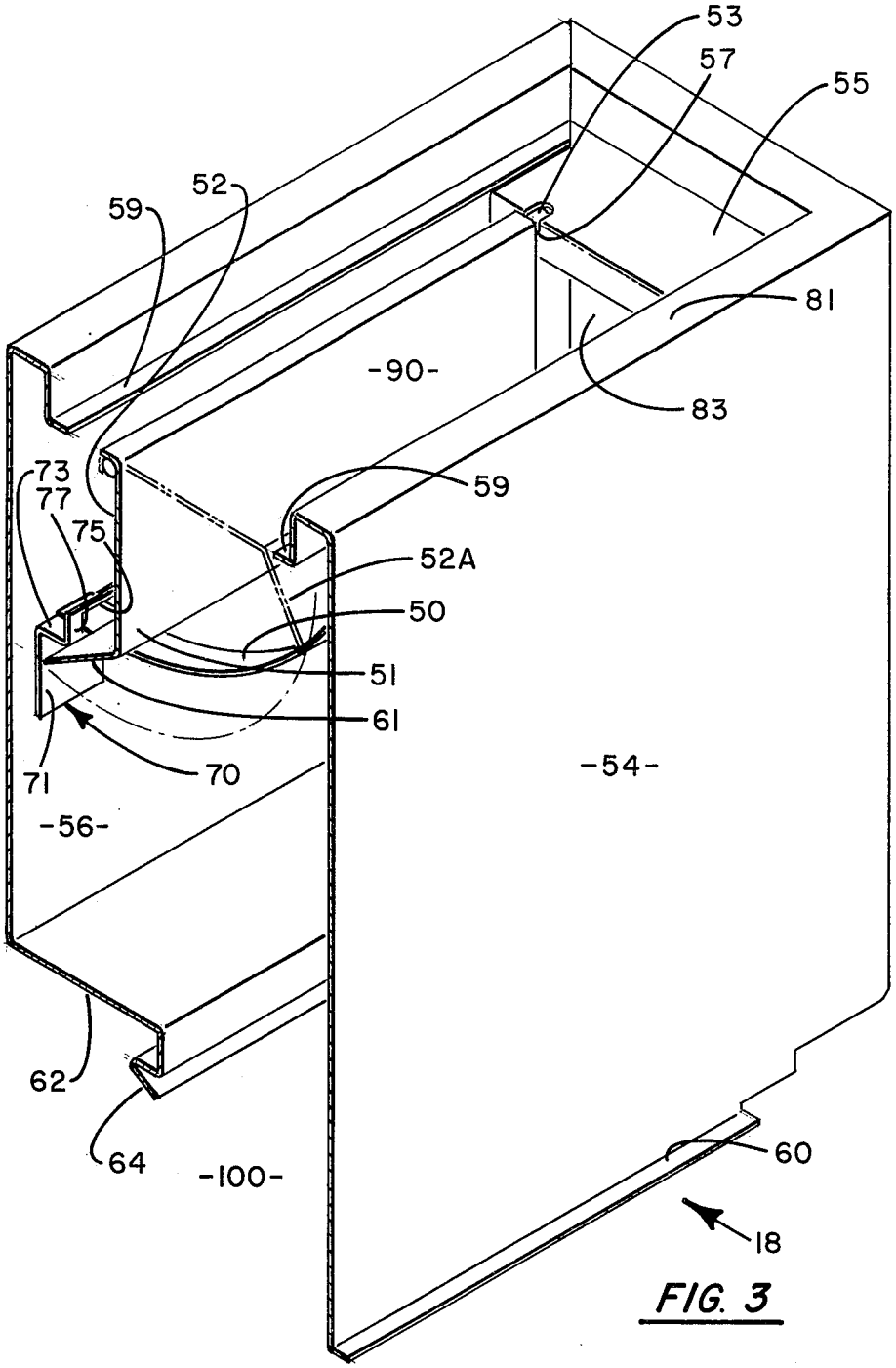
FIG. 3 is an isometric view of the adapter taken at line III—III of FIG. 1.

Adapter 18 is shown in FIG. 3. Adapter 18 has front wall 54 including front lip 60, side wall 83 and back wall 56 including back ledge 62 and back flange 64. The adapter additionally has top wall 81 which further includes grille support lip 59 and pivot support 55.

Damper 52 is shown mounted for pivotal rotation on damper pivot rod 53 which is secured in pivot rod cradle 57 formed as a part of pivot support 55. Damper 52 has damper body portion 51 and damper extension 61. Flexible spring 50 is shown mounted between the junction of top wall 81 with front wall 54 and spring bracket 70. Spring bracket 70 has mounting portion 71 affixed to back wall 56 and extension portion 73 connected to the support portion 71. Support portion 77 has a slot 75 formed therein such that the spring is maintained between the junction of the top wall with the front wall and the spring bracket. It can be further seen that the spring 50 is of a length greater than the distance between the bracket and junction such that it is bowed in an arcuate configuration. Damper 52 rotates such that damper extension 61 contacts spring 50 in its various positions. By manually rotating the damper in engagement with the spring, a sufficient force is imparted between the edge of the damper extension and the spring such that the damper is secured in the position to which it has been rotated.

It can be additionally seen in FIG. 3 that when the damper is in the position shown that there is little impediment to air being received through inlet 100 of the adapter and being discharged through outlet 90 of the adapter. The damper is also shown as indicated by reference 52A in the fully closed position wherein air flow through outlet 90 is substantially blocked.

Figure 4:
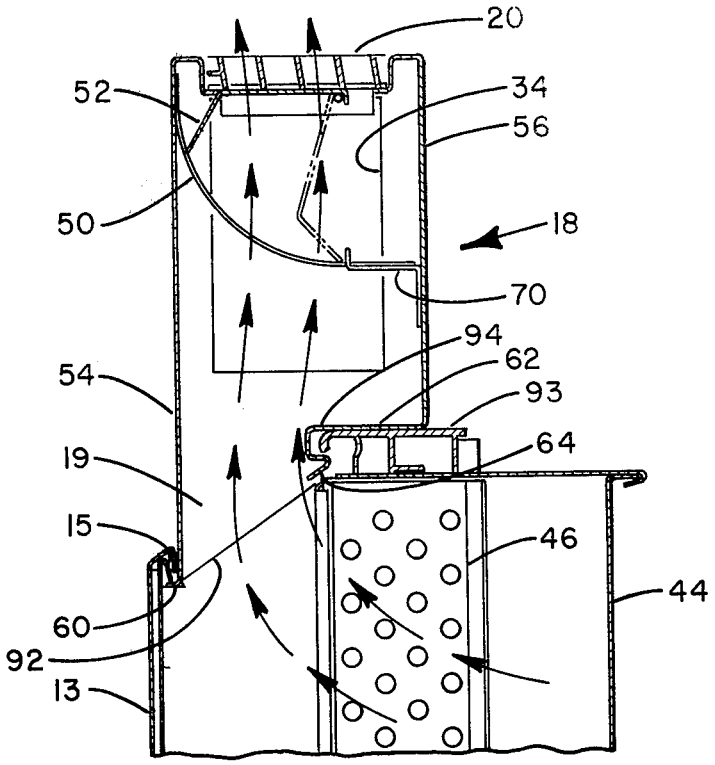
FIG. 4 is a sectional view of a portion of the packaged terminal air conditioning unit with the adapter assembled thereto.
Figure 5:
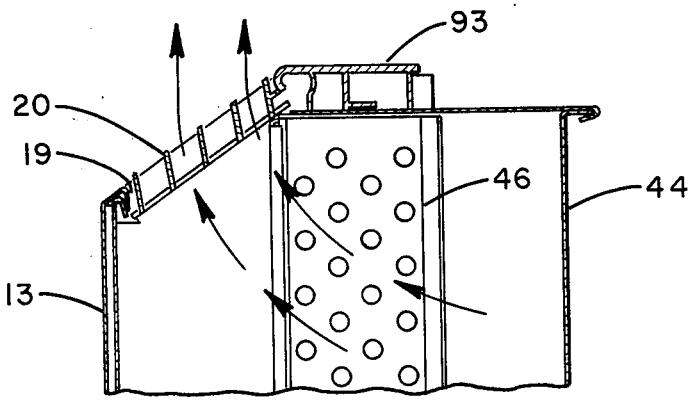
FIG. 5 is a sectional portion of a packaged terminal air conditioning unit showing the grille mounted to cover the discharge opening.

Referring now to FIG. 4, the assembly of the adapter to the air conditioning unit is shown. FIG. 5 shows an air conditioning unit without the adapter assembled thereto. It can be seen therein that discharge grille 20 is inserted to cover discharge air opening 19. Front subcover 13 and top surface 93 are shown adjacent grille 20. Additionally evaporator 46 and partition 44 are shown for general reference.

Adapter 18 is shown assembled to the unit in FIG. 4. Therein the discharge grille has been removed to promote air flow through discharge opening 19 of the unit into the adapter. The various walls of the adapter, the damper and spring for supporting the damper are additionally disclosed in FIG. 4. Discharge grille 20 is shown mounted at the top discharge air opening of the adapter.

Additionally shown is extension opening 34 in side wall 83 of the unit. This opening is configured to be joined to duct extension 30. It may be seen in FIG. 4 that back wall 56 of the unit includes a back ledge 62 and back flange 64. When assembled, it is apparent that back ledge 62 is supported by top surface 93 of the air conditioning unit and that back flange 64 partially engages top lip 94 of top surface 93. Additionally it can be seen that front lip 60 connected to front wall 54 engages lip 15 of front subcover 13. When the unit is assembled in this manner, the adapter is secured relative to the air conditioning unit.

The adapter has two side walls 83, one on each end thereof. Each side wall may have an extension opening 34. The duct extension 30 is adapted to be connected to either side wall such that the location of the duct extension is capable of being switched from one side of the unit to the other. A cap may be provided for the unit such that the duct extension may be fastened to one side wall of the adapter and the cap affixed to cover the duct opening in the other side wall of the adapter. Consequently, two air flow paths are provided from the adapter, one through the adapter discharge at the top thereof and one through the extension opening in the side wall.

With the combination of discharge openings as shown, when the damper is in the fully open position, substantially all of the air being discharged from the air conditioning unit will be discharged into the enclosure through the discharge opening of the adapter. When the damper is moved to impede a portion of this flow, some of the air will then be discharged through the duct opening in the side wall and through the duct extension to the adjacent sub-enclosure. The air flow resistance through the top discharge opening is less than through the duct opening such that when the damper is in the fully open position there is very little air flow through the duct opening into the duct extension. Hence, by adjusting the position of the damper it is possible to regulate the division of the air flow between the top discharge opening of the adapter and the duct opening in the side wall of the adapter.

Arrows, as drawn in FIG. 4, show the air flow path of the conditioned air from the unit. The air flows from right to left through evaporator 46 and upwardly through discharge opening 19 into the adapter. Once in the adapter, a portion of the air flows around damper 52 and is discharged outwardly from the unit through grille 20 at the top thereof. A portion of the air is also directed upwardly out of the drawing as shown by the circles having a dot in the middle through the duct extension to the adjacent sub-enclosure.

The invention has been described herein with reference to a particular embodiment thereof. It is to be understood that variations and modifications can be effected herein within the spirit and scope of the invention.

We claim:

1. Apparatus for attaching a duct to a unit supplying conditioned air having a discharge opening covered by a removable grille which comprises:

a housing adapted to be connected to the unit to encase the discharge opening, said housing defining an air flow path for the conditioned air discharged from the unit, said housing including:

a. a front wall, b. a rear wall, c. at least one side wall joining the front wall to the rear wall, said side wall having a duct opening therein, d. means attached to at least one of the front wall, rear wall or side wall for securing the housing to the unit, and e. a top wall connected to the front wall, rear wall and side wall, said top wall defining a top air discharge opening;

a damper assembly located within the housing to direct conditioned air discharged from the unit between the top discharge opening and the duct opening; and means for securing a duct to the housing at the duct opening.

2. The apparatus as set forth in claim 1 and further comprising a duct which may be secured to a side wall of the housing at the duct opening.

3. The apparatus as set forth in claim 1 wherein the top wall of the housing includes grille support means such that the grille removed from the air conditioning unit to allow installation of the housing may be supported by the top wall of the housing to cover the top air discharge opening.

4. The apparatus as set forth in claim 1 wherein the air conditioning unit includes a top surface including a top lip defining a portion of the discharge opening and wherein the means for securing the housing to the air conditioning unit further comprises a back ledge formed as a part of the back wall for supporting the housing by resting on the top surface of the unit, said back ledge including a back flange configured to partially encase the top lip and to engage the bottom surface of the top lip whereby the back ledge secures the housing relative to the air conditioning unit.

5. The apparatus as set forth in claim 4 wherein the air conditioning unit further includes a front vertical member including a lip and wherein the means for securing the housing to the unit further comprises a front lip formed as a part of the front wall of the housing, said front lip engaging the front vertical member to further secure the housing to the unit.

6. The apparatus as set forth in claim 2 wherein the housing includes two sidewalls, each sidewall having a duct opening formed therein and further comprising a duct opening cover fastened to prevent air from being discharged from one of said duct openings, whereby the duct may be secured to either side wall and the other side wall has the cover secured thereto such that conditioned air may, by the proper positioning of components, be discharged through either sidewall.

7. Apparatus for attaching a duct to an air conditioning unit having a conditioned air discharge opening covered by a removable grille which comprises:

a housing connected to receive the conditioned air discharged from the air discharge opening, said housing having a housing air discharge opening and a duct opening formed therein and including means for securing the housing to the air conditioning unit at the discharge opening;

means located within the housing for directing conditioned air discharged from the air conditioning unit between the housing air discharge opening and the duct opening, whereby the conditioned air being discharged from the unit may be dispersed to separate discharge air streams one flowing from the housing through the housing discharge and the other flowing from the housing through the duct opening.

8. The apparatus as set forth in claim 7 wherein the means for securing the housing to the air conditioning unit further comprises grille support surfaces formed about the housing air discharge openings to support a grille for covering said opening, said support surfaces being sized such that the removable grille from the air conditioning unit may be supported therein to cover the housing discharge opening.

9. The apparatus as set forth in claim 7 wherein the means located within the housing for directing conditioned air includes a damper assembly having a damper which may be fixed to direct selected amounts of conditioned air to the housing discharge opening and the duct opening.

10. The apparatus as set forth in claim 7 wherein the housing has formed as a portion thereof walls including means adapted to coact with portions of the air conditioning unit to secure the housing thereto.

* * * * *